United States Patent [19]

Campanella et al.

[11] 4,438,532

[45] Mar. 27, 1984

[54] PROTECTIVE GLOVE

[76] Inventors: Alexander F. Campanella, 22 15th St., Buffalo, N.Y. 14213; J. David Bannon, 246 Bryant St., Buffalo, N.Y. 14222

[21] Appl. No.: 497,055

[22] Filed: May 23, 1983

[51] Int. Cl.[3] ..... A41D 13/10

[52] U.S. Cl. ..... 2/16; 2/161 A

[58] Field of Search ..... 2/161 R, 161 A, 160, 2/163, 16, 20, 21; 128/77, 87 A

[56] References Cited

U.S. PATENT DOCUMENTS

| | | | |
|---|---|---|---|
| 1,471,948 | 10/1923 | Cox et al. | 128/87 A |
| 2,388,330 | 11/1945 | Jungmann | 2/20 X |
| 2,567,489 | 9/1951 | Lewis | 2/20 |
| 2,709,257 | 5/1955 | McKinney | 2/16 |

FOREIGN PATENT DOCUMENTS

| | | | |
|---|---|---|---|
| 278428 | 10/1927 | United Kingdom | 2/161 A |

*Primary Examiner*—Werner H. Schroeder
*Assistant Examiner*—Tracy Graveline
*Attorney, Agent, or Firm*—Allen J. Jaffe

[57] ABSTRACT

A protective glove having a rigid thumb protecting member overlying the outer portion of the thumb from a point beyond the interphalangeal joint thereof to a point beyond the first metacarpal; a rigid dorsal extension integrally formed with the thumb protecting member and overlying the metacarpals between the knuckles and the wrist; and a strap connected to the palmer surface of the protecting member and crossing the first web space to apply a force against the metacarpal phalangeal joint.

10 Claims, 5 Drawing Figures

PROTECTIVE GLOVE

BACKGROUND OF THE INVENTION

The present invention relates to gloves or mittens and, more particularly, to such a glove or mitten which functions to protect the thumb against most common injuries associated with outdoor sports and/or other similar activities.

Thumb injuries are among the most common upper extremity injury in many outdoor sports or non-sports related activities such as, for example, skiing. Of the injuries the thumb is most prone to, those to the ulnar collateral ligament are potentially seriously disabling. Such injuries often require surgical repair or reconstruction and are more commonly known as "game keepers thumb" or, among skiers, as "skiers thumb".

The force that is responsible for the ulnar collateral ligament injury is most likely an extention-radial deviation type stress which may occur in skiing, for example, when (upon falling) the thumb is impacted into the snow and dragged or, when (on a forward fall) the ulnar aspect of the thumb is forced against the planted ski pole. This occurs as a result of holding the ski pole with the strap around the wrist passing through the palm. The thumb is then forced into extension and radial deviation between the pole and the strap.

Recent studies suggest that upper extremity injuries are increasing, probably due to new "hot dogging" techniques which employ various types of gymnastics and maneuvers requiring further pole support and higher rates of speed. Moreover, since modern ski boots tend to push the skier forward, he is more prone to falling foward and injuring an upper extremity.

The ulnar collateral ligament may tear in mid substance; may be avulsed from the base of the proximal phalanx or the metacarpal, or may be, simply, stretched. Although ulnar collateral ligament injuries are the most common thumb injuries amongst skiers, other injuries also occur, including both fractures and dislocations.

There are a number of prior art gloves which provide limited protection for the thumb.

One such glove is disclosed in prior U.S. Pat. No. 4,137,572 which relates to a hockey glove wherein a stiff protection strip is located in the outer padding covering the thumb and extends along the outer or radial side of the thumb from the tip thereof, passed the thumb root and wrist and to the forearm. While this protective strip may be effective in preventing the thumb from being bent backwards and in against the wrist, and also against direct blows as occur in hockey, it cannot effectively protect against ulnar collateral ligament injuries, as well as other injuries to the thumb including fractures and dislocations.

Another protective glove is disclosed in U.S. Pat. No. 4,295,229 wherein webbing is provided between the thumb and fingers to limit the degree of separation therebetween. A thumb pad is also provided for the first or distal phalange.

Prior U.S. Pat. No. 4,287,610 relates to a protective device contoured to the shape of the hand.

U.S. Pat. No. 4,243,026 relates to a finger splint employing orthotic three-point fixation.

SUMMARY OF THE INVENTION

The glove of the present invention is orthotically constructed to protect the thumb against all ulnar collateral ligament injuries and most other injuries that may be associated with high speed or high impact activities such as, but not necessarily limited to, skiing.

In the field of orthotics, it is well accepted that to completely stabilize or immobilize any joint, a three point fixation must be provided. That is, three forces must be applied; a central force in one direction that is opposed by two outer forces applied opposite to the central force. Thus, to stabilize the thumb against ulnar collateral ligament injuries the glove of the present invention incorporates a rigid thumb protection means so constructed as to apply a force at the first web space (between the thumb and the index finger), overlying the ulnar collateral ligament, which is directed outwardly against the thumb's metacarpal phalangeal joint and which is resisted by a pair of spaced, opposed forces that are directed inwardly from the thumb's distal phalange (on one side) and from the metacarpal (on the other side). In this manner, the ulnar collateral ligament is completely protected against injury.

The glove of the present invention further includes means to protect the thumb against other injuries such as dislocations, fractures and other soft tissure injuries. To this end, a rigid dorsal extension is integrally formed with the thumb protecting means and is contoured to overlie at least the second, third and a portion of the fourth metacarpal. The dorsal extension is securely locked or strapped to the wrist so as to fully stabilize the thumb protecting means against movements that might otherwise subject the the thumb to other injuries.

Essentially, then, the present invention provides a protective glove having at least one finger stall portion enclosing the fingers; an intermediate portion enclosing the hand; a cuff portion enclosing the wrist; a thumb stall portion enclosing the thumb; a rigid thumb protecting member secured to the glove and covering the outer portion of the thumb from a point beyond the interphalangeal joint thereof to a point beyond the first metacarpal but short of the carpals; and means secured to the protecting member and located in the first web space between the thumb and forefinger for applying a substantially outward force to the thumb's metacarpal phalangeal joint.

A rigid dorsal extension member is integrally formed with the thumb protecting member and covers, in substantially contoured relation thereto, the hand between the knuckles or metacarpal phalangeal joints thereof and the wrist or carpals and extends from the thumb protecting member over to at least the center of the fourth metacarpal; and is secured or locked to the wrist by means engaging the extension at a point or points thereon such that lateral or radial movement of the thumb with respect to the wrist is restrained.

Other characterizing features and advantages of the invention will become readily apparent from the ensuing description thereof.

BRIEF DESCRIPTION OF THE DRAWINGS

For a fuller understanding of the present invention reference should be made to the following detailed description thereof taken in conjunction with the accompanying drawings, wherein.

DETAILED DESCRIPTION OF THE PREFERRED EMBODIMENT

Figure 1:
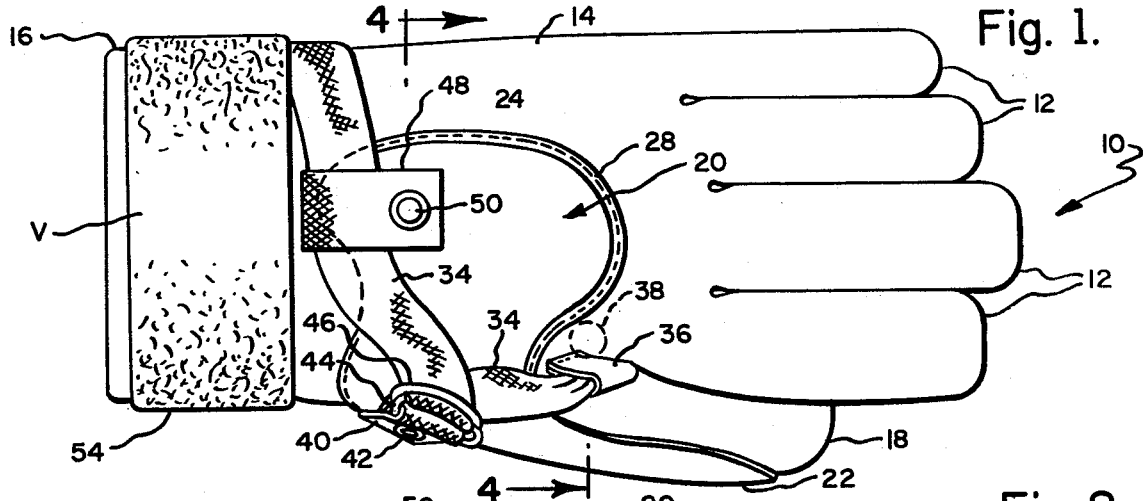
FIG. 1 is a top or dorsal view of the protective glove.
Figure 2:
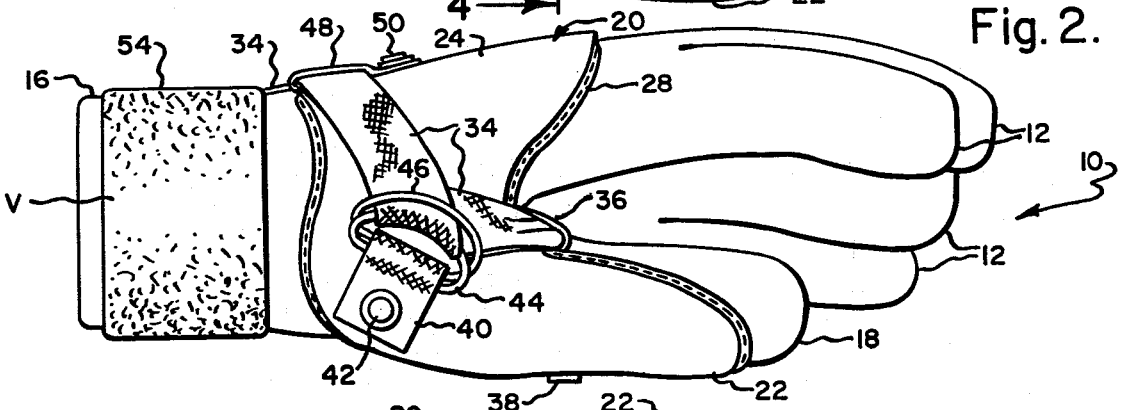
FIG. 2 is a side view thereof.

Referring in detail to the drawings, the protective glove is generally indicated at 10 and is shown as comprising a plurality of finger stall portions 12 enclosing the fingers, a hand portion 14 enclosing the hand, a cuff portion 16 enclosing the wrist and a thumb stall portion 18 enclosing the thumb. In the case of a mitten, the finger stalls 12 would comprise a single stall enclosing all of the fingers, as is well known. The portions 12, 14, 16 and 18 may be fabricated of any suitable, pliable material or fabric and secured together, as is known in the glove making art.

Figure 4:
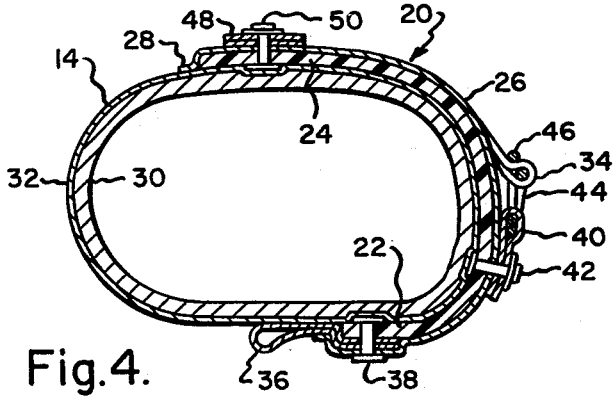
FIG. 4 is a cross-sectional view taken substantially along line 4—4 of FIG. 1.
Figure 5:
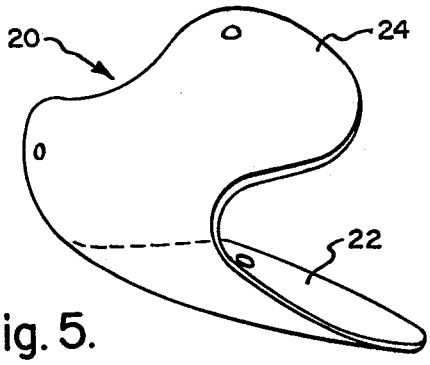
FIG. 5 is a pictorial view of the combined protective reinforcing member including the thumb portion and the dorsal extension.

In accordance with the present invention, a thumb protecting member, generally depicted at 20, is suitably secured to and carried by glove 10. Member 20 includes a curved thumb portion 22 contoured to fit about the outer portion of the thumb and an integrally formed dorsal extension 24 contoured to fit on the dorsal or back portion of the hand and may be fabricated of any suitable rigid material such as plastic or metal. Member 20 may be fully coated with an outer cushioned layer or padding 26 (FIG. 4) which is secured to the glove by stiching or the like 28. An inner cushioned layer (not illustrated) may also be provided to fully enclose the member 20 prior to its attachment to the glove. Alternatively, glove 10 may be manufactured with the protecting member 20 located between the inner and outer layers 30 and 32 thereof. In any event, the member 20 is securely affixed to the glove 10 such that no relative movement is permitted therebetween.

The curved thumb portion 22 reinforces the thumb stall 18, cups the outer contour of the thumb and extends therealong from a point distally beyond the interphalangeal joint thereof to a point proximally beyond the metacarpal phalangeal joint and may extend upto, but not beyond, the carpals or the wrist crease. The longitudinal center of portion 22 is on the outer or radial side of the thumb directly opposite to the deep portion of the first web space between the thumb and the index finger at the metacarpal phalangeal joint. In this manner, inward forces can be applied by portion 22 on opposite sides of the metacarpal phalangeal joint in opposition to an outward force applied thereat; which forces completely stabilize the thumb and the ulnar collateral ligament.

Such outward force is provided by suitable means in the form of a strap 34 passing through and stiched to a sheath 36 which is securely fastened, as by rivet 38, to the body or protecting member 20 on the palmer surface. Alternatively, sheath 36 may be eliminated and one end of strap 34 could be fastened directly to member 20. Since the strap 34 extends across the first web space, tightening thereof will exert an outward force against the meatcarpal phalangeal joint which is effectively resisted by the inward forces applied by protective portion 22 on opposite sides of this joint. Thus, a three point orthotic fixation of the ulnar collateral ligament is established and protection against injury thereto is assured.

Figure 3:
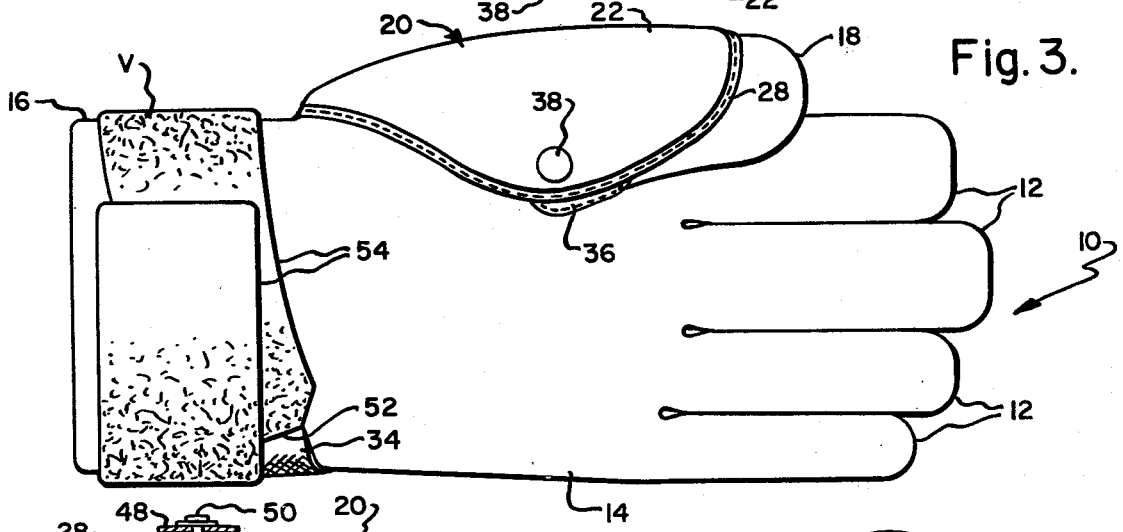
FIG. 3 is a palmer or bottom view thereof.

Suitable means are provided to properly direct the forces of strap 34 against the metacarpal phalangeal joint and to permit adjustment and tightening thereof. Such means may comprise a loop 40 secured, as by rivet 42, to the dorsal surface of member 20 and a pair of "D" rings 44, 46 secured through the loop. Strap 34 passes under and over ring 44 and under ring 46 such that the same may be releasably and adjustably locked in place by the pressure of the two rings thereagainst. A second loop 48 is fastened, by rivet 50, to the dorsal extention portion 24. Strap 34 passes through loop 48 and is joined at 52 (FIG. 3) to a wrist strap 54 that is wrapped around cuff portion 16 to securely tighten the assembly. Wrist strap 54 may be provided with VELCRO ® material V or the like for tightening purposes.

It should be noted that loop 40 is secured to member 22 substantially at the proximal base of the first metacarpal to thereby properly reorient the line of pull from wrist strap 54 such that the force applied by strap 34 is properly vectored at the metacarpal phalangeal joint. Also, loop 48 is secured substantially at the proximal base of the third metacarpal to apply a moment to dorsal extension 24 about fulcrum point 42 that tends to counteract lateral displacements of the thumb with respect to the wrist in the radial direction, when the straps 34 and 54 are securely tightened. The thumb is, thus, effectively restrained from movements that might cause injuries other than to the ulnar collateral ligament.

It should also be readily apparent that, in addition to providing stabilization of thumb portion 22, dorsal extension 24 also provides protection against injuries of the dorsal aspect of the hand as might occur through direct minor impacts thereto.

Although a preferred embodiment of the present invention has been disclosed and described, changes will obviously occur to those skilled in the art, without departing from the spirit thereof. It is, therefore, intended that the present invention is to be limited only by the scope of the appended claims.

What is claimed is:

1. A protective glove, comprising:

at least one finger stall portion enclosing the fingers;

an intermediate portion enclosing the hand;

a cuff portion enclosing the wrist;

a thumb stall portion enclosing the thumb;

a rigid thumb protecting member secured to the glove and spanning the metacarpal phalangeal joint of the thumb; and means secured to the protecting member and located in the first web space between the thumb and index finger applying a substantially outward force to the thumb's metacarpal phalangeal joint.

2. The glove according to claim 1, wherein:

said thumb protecting member covers the thumb's interphalangeal joint.

3. The glove according to claim 1, further comprising:

a rigid dorsal extension member integrally formed with said thumb protecting portion and contoured to overlie the hand in the metacarpals region thereof.

4. The glove according to claim 3, wheren:

said thumb protecting member covers the thumb's interphalangeal joint.

5. The glove according to claim 3, wherein:

said means comprises a strap having one end fixed to said protecting member in the palmer region thereof adjacent said web space.

6. The glove according to claim 5, further comprising:

means secured to said protecting member on the dorsal surface thereof to adjust the tension of said strap against said web space.

7. The glove according to claim 6, wherein:

the other end of said strap is wrapped about said cuff portion; and there is further provided a loop on said dorsal extension in the vicinity of the proximal base of the third metacarpal through which said strap passes prior to being wrapped about said cuff portion.

8. The glove according to claim 1, wherein:

said means comprises a strap having one end fixed to said protecting member in the palmer region thereof adjacent said web space.

9. The glove according to claim 8, further comprising:

means secured to said protecting member on the dorsal surface thereof to adjust the tension of said strap against said web space.

10. The glove according to claim 9, wherein:

said thumb protecting member covers the thumb's interphalangeal joint.

* * * * *